US009247777B2

(12) United States Patent
Sullivan et al.

(10) Patent No.: US 9,247,777 B2
(45) Date of Patent: Feb. 2, 2016

(54) FABRIC CONTAINMENT DEVICE

(71) Applicants: Deborah Sullivan, Amherst, NY (US); Kaelyn Kelly Sullivan, Amherst, NY (US); Camryn Collins Sullivan, Amherst, NY (US)

(72) Inventors: Deborah Sullivan, Amherst, NY (US); Kaelyn Kelly Sullivan, Amherst, NY (US); Camryn Collins Sullivan, Amherst, NY (US)

( * ) Notice: Subject to any disclaimer, the term of this patent is extended or adjusted under 35 U.S.C. 154(b) by 290 days.

(21) Appl. No.: 13/940,816

(22) Filed: Jul. 12, 2013

(65) Prior Publication Data

US 2015/0013049 A1 Jan. 15, 2015

Related U.S. Application Data

(60) Provisional application No. 61/673,438, filed on Jul. 19, 2012.

(51) Int. Cl.
*A44B 6/00* (2006.01)
*A41F 19/00* (2006.01)

(52) U.S. Cl.
CPC ..... *A41F 19/00* (2013.01)

(58) Field of Classification Search
CPC . Y10T 24/13; Y10T 24/1303; Y10T 24/1306; Y10T 24/1309; Y10T 24/155; Y10T 24/44034; A41F 19/00; A41F 5/02; A41F 99/00; A44B 6/00
USPC ..... 24/3.12
See application file for complete search history.

(56) References Cited

U.S. PATENT DOCUMENTS

| | | | | | |
|---|---|---|---|---|---|
| 956,991 | A * | 5/1910 | Nathanson | 132/279 |
| 987,407 | A * | 3/1911 | Scott | 24/17 R |
| 2,400,626 | A * | 5/1946 | Brede | 224/236 |
| 2,981,990 | A * | 5/1961 | Balderree, Jr. | 24/30.5 R |
| 5,156,023 | A * | 10/1992 | Bevolo | 63/20 |
| 5,511,289 | A * | 4/1996 | Melia | 24/66.9 |
| 5,557,830 | A * | 9/1996 | Davis | 24/459 |
| 5,765,232 | A * | 6/1998 | Pryor | 2/217 |
| 5,990,402 | A * | 11/1999 | Epstein | 84/422.3 |
| 2010/0043125 | A1* | 2/2010 | MacLean | 2/336 |

* cited by examiner

*Primary Examiner* — Robert J Sandy
*Assistant Examiner* — Matthew Sullivan
(74) *Attorney, Agent, or Firm* — Vincent G. LoTempio; Kloss, Stenger & LoTempio; David T. Stephenson

(57) ABSTRACT

A device for gathering and containing a portion of fabric of a garment, such as a T-shirt and maintaining the gathered configuration of the fabric while providing a tighter fit of the garment. The device comprises a four sided outer frame having a semicircular lower side member, an upper side member, two upright members, and two internal crossbars providing three openings through which the fabric is passed to form the gathered configuration.

10 Claims, 4 Drawing Sheets

FABRIC CONTAINMENT DEVICE

CROSS REFERENCE TO RELATED APPLICATIONS

This application claims the benefit of United States Provisional Application of Deborah Sullivan, Ser. No. 61/673,438 filed 19 Jul. 2012, having the title FABRIC CONTAINMENT DEVICE, which is incorporated herein by reference in its entirety.

BACKGROUND OF THE INVENTION

1. Field of the Invention

The present invention relates to a device and method of use for holding fabric, such as the cloth of a garment, in a gathered configuration to improve the fit and style of the garment.

2. Background

"Off the shelf" garments, such as T-shirts, blouses, shirts, sweaters, and the like are often ill-fitted with a tendency toward a loose fit. Fashion trends and personal preference have created a need to achieve a slimmer fit for such top garments. Such slimmer fits are often achieved by tying the cloth into a knot at the lower portion of the garment, usually in the front or back. Alternatively, slimmer fits are often achieved by the use of string ties, elastic waistbands, belts or the like or by tucking the garment into the wearer's skirt, slacks, or shorts.

In recent years, partially as a result of the increased popularity of T-shirts as an article of casual dress, various devices have been designed to accept and hold a gathered portion of a top garment to provide a slimmer and more acceptable fit. Many of such devices rely on friction (the fabric against the device) to hold the gathered fabric in place. However, during use, movement of the wearer is often sufficient to overcome the friction hold and loosen the gathered fabric, requiring the wearer to adjust and reposition the gathered fabric and holding device, or risk having the gathered fabric loosen sufficiently to allow the device to fall off and possibly become lost. Furthermore, in use, major portions of the device are often exposed and may not blend well or complement the fabric.

Various devices are known for holding gathered fabric of wearing apparel in place. For example:

U.S. Pat. No. 5,511,289 discloses a two part locking buckle for use with a flexible material such as a T-shirt or other fabric. The buckle consists of a round housing having a cross-bar across the center, thereby forming two openings. Fabric is passed up through one opening and down through the second opening. The second component, a rigid locking member and cover, is then inserted into the housing to prevent the fabric from dislodging from the buckle. Decorations or design may be added to the top surface of the cover for ornamentation.

U.S. Pat. No. 5,765,232 discloses a bustling device for supporting the train of a bridal gown.

U.S. Patent Application No. 2010/0043125 discloses an apparatus for cinching a garment. The apparatus is a single piece unit having an outer perimeter and a number of inner members that generally form an x-shaped opening through which a portion of the garment may be pulled and secured.

SUMMARY OF THE INVENTION

It is an object of the present invention to provide a device and method for the gathering of fabric, such as the cloth of a garment, and the holding of the gathered fabric in the gathered configuration.

It is a further object to provide such a device and method that will allow the wearer of a garment to improve the fit and style of the garment.

It is a further object to provide such a device that can be used and removed conveniently without causing damage to the garment.

It is an additional object to provide a device that will hold the gathered fabric in the gathered configuration without loosening during normal activities of the wearer.

It is a still further object to provide such a device that may also hold an "add-on" accessory that can be conveniently attached to the device after gathering and holding the fabric and detached and replaced easily. The accessory may be a decoration selected to enhance the appearance of the gathered fabric, complement the garment or general attire of the wearer, or to serve some utilitarian purpose. Decorative accessories may include, for example, bows, flowers, gemstones, designs, etc. Accessories may be personalized in various ways, for example by presenting the wearer's name or a logo identifying some special interest of the wearer. A preferred add-on decoration that serves a utilitarian purpose is one that provides a light or reflector that will render the wearer more visible when, for example, bicycling, skating, skateboarding, hiking or the like at night.

The above and other objects are achieved in accordance with the present invention which is a fabric containment device suitable for holding the gathered cloth of a garment, and a method for the use of the device. The fabric containment device comprises a four sided semi-rigid surrounding frame comprising a semicircular lower side member attached at each end to one of two upright supporting side members which are further connected to each other at their upper ends by an upper side member. The two supporting sides are further connected within the surrounding frame member by an upper internal crossbar and a lower internal crossbar.

The upright supporting sides are bent between the upper and lower internal crossbars to position the semicircular lower side of the device in a plane slightly forward of the plane of the device between the upper side and upper internal crossbar. The device is often worn at the front and bottom of a top garment, such as a T-shirt, when worn in this manner, if the wearer raises his/her arms upward, the device has a tendency to flip over. By providing the aforementioned bend to position the semicircular lower portion of the device in a plane slightly forward of the plane of the upper portion the tendency of the device to flip over is inhibited.

In a preferred embodiment, the fabric containment device is provided with a means, preferably located at or near the midpoint of the lower internal crossbar, for attaching and detaching an accessory, such as a decoration, a logo, a light, a reflector, or other desired add-on feature. Suitable attachment means might include, for example, a clip, snap button, hook and loop fastener, or other easily attachable and detachable means. Given the ease with which an accessory can be attached and detached the wearer may find it desirable to have a variety of accessories to use for various activities or to complement in color or style the clothing worn on any occasion.

BRIEF DESCRIPTION OF THE DRAWINGS

The present invention will be more clearly understood by reference to the following detailed description when read in conjunction with the accompanying drawing in which the like reference characters refer to like parts throughout the views and in which.

DETAILED DESCRIPTION OF THE INVENTION

Figures 1, 2, 3:
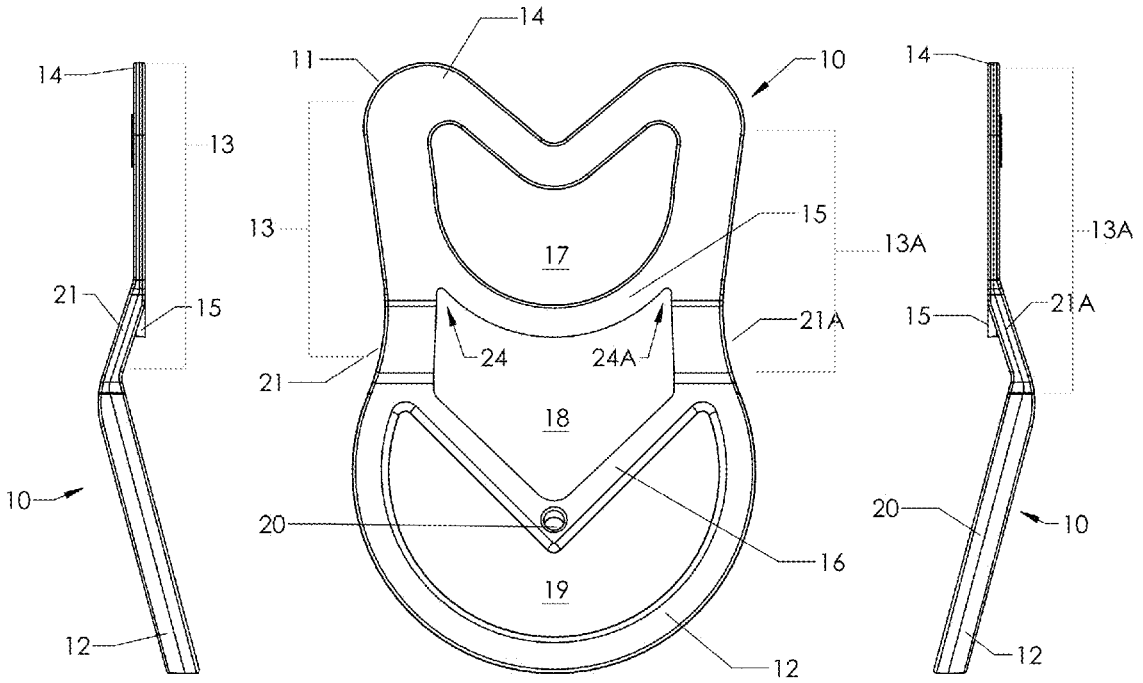
FIG. 1 is a front view of a fabric containment device of this invention.
FIG. 2 is a side view of the device illustrated frontally in FIG. 1.
FIG. 3 is a mirror image of FIG. 2 showing the left side of the fabric containment device.
Figure 4:
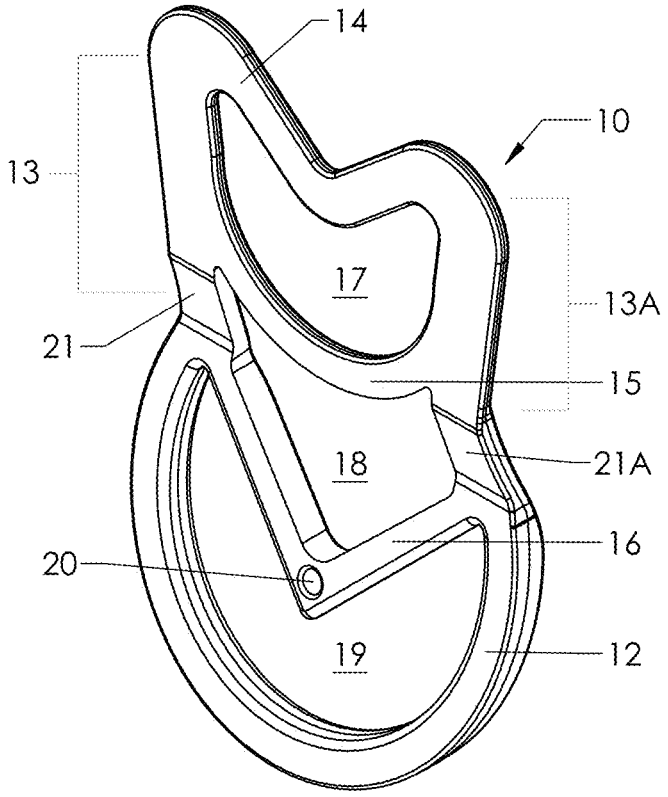
FIG. 4 is a perspective view of the fabric containment device.
Figure 5:
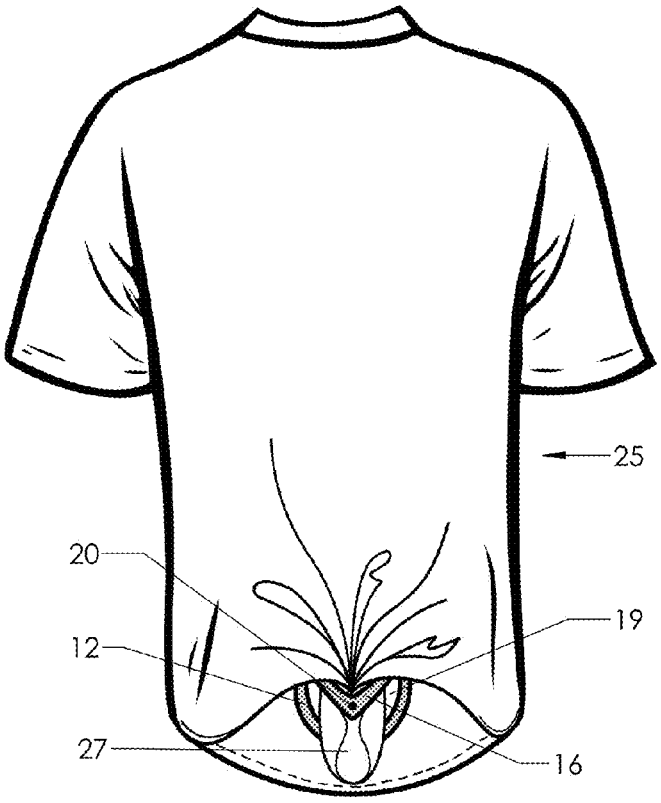
FIG. 5 is front view of a T-shirt wherein the process of fabric gathering in the device has been initiated.

With reference in detail to the drawings: FIGS. 1, 2, 3, and 4 show a fabric containment device 10 in accordance with the present invention, including a four-sided surrounding frame 11, the four sides including a semicircular lower side member 12, attached at each end to the lower end of one of two upright supporting side members, 13 and 13A and an upper side member 14 connecting the upper ends of the upright supporting side members 13 and 13A. In the figure shown upper side member 14 is moderately V-shaped. However, various other shapes, such as a straight or a moderately rounded upper side member 14 may be employed. The device 10 further contains within the surrounding frame 11 an upper internal crossbar 15 and a lower internal crossbar 16, each connecting upright supporting side member 13 with upright supporting side member 13A. Upper internal crossbar 15 is preferably moderately rounded as shown. However, other shapes, such as straight across may be employed. The lower internal crossbar 16 is preferably V-shaped as shown. Regardless of the particular shape of the internal crossbar 15, the angles 24 and 24A should be between forty-five (45) degrees and ninety (90) degrees to provide an adequate containment of the gathered fabric.

With reference to FIGS. 1, 2, 3 and 4 the upright supporting side members 13 and 13A of device 10 are bent between the upper and lower internal crossbars 15 and 16 to form bends 21 and 21A in upright supporting side members 13 and 13A respectively, thus positioning the lower portion of the device, including the lower internal crossbar 16 and the semicircular lower side member 12 of the device 10 in a plane slightly forward of the plane of the device between the upper side member 14 and upper internal crossbar 15.

Within the device 10, the crossbars and surrounding frame members collectively form three openings, 17, 18 and 19 through which, in use, the fabric can be passed to form a gathered configuration of the fabric. Opening 17 is formed within the boundaries of upper side member 14, upright supporting side members 13 and 13A, and upper internal crossbar 15. Opening 18 is formed within the boundaries of upper internal crossbar 15, bends 21 and 21A, and lower internal crossbar 16. Opening 19 is formed within the boundaries of lower internal crossbar 16, and semicircular lower side member 12.

In a preferred embodiment, means 20 for attaching an add-on accessory, as described hereinabove, is provided at the midpoint of lower internal crossbar 16.

FIGS. 2 and 3 show side views of the right and left sides respectively of device 10 of FIG. 1.

With further reference to FIGS. 1, 4, 5, 6, 7 and 8, the method of the present invention for gathering and holding the fabric of a garment in device 10, is carried out by first inserting the leading edge 27 of the fabric through the front of opening 18 to the back of the device and then pulling the fabric downwardly across the back of the lower internal crossbar, then through opening 19 to the front (FIG. 5), then over and behind the semicircular lower side member 12 of the surrounding frame to a position on the back (FIG. 6), then through opening 18, to the front, then over the upper internal crossbar 15 through opening 17 to the back.

Figure 6:
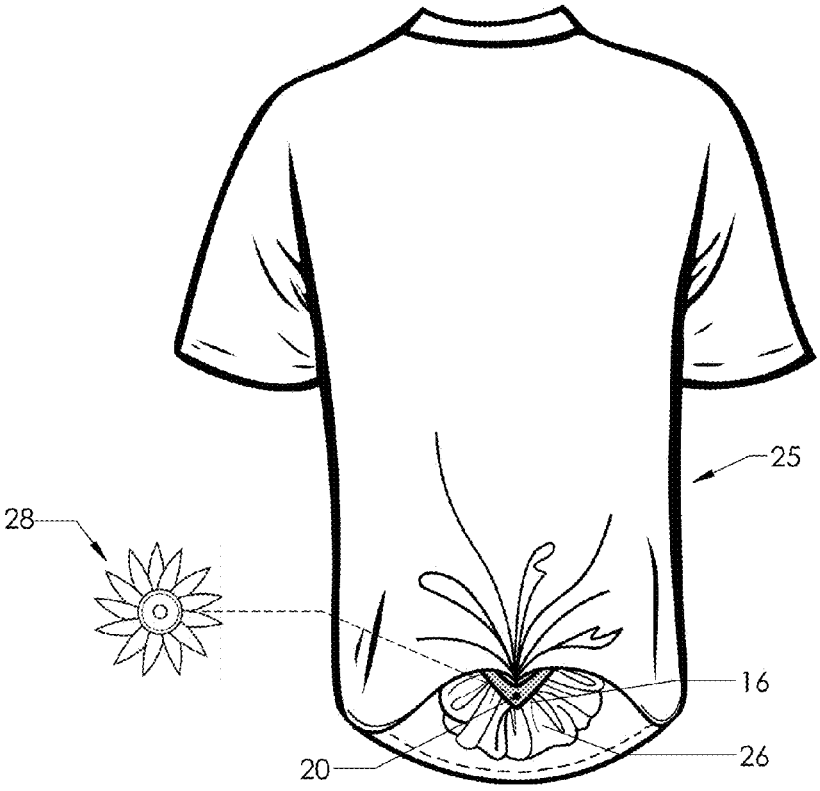
FIG. 6 is a front view of a T-shirt wherein the fabric gathering process has been continued from that depicted in FIG. 5.
Figure 7:
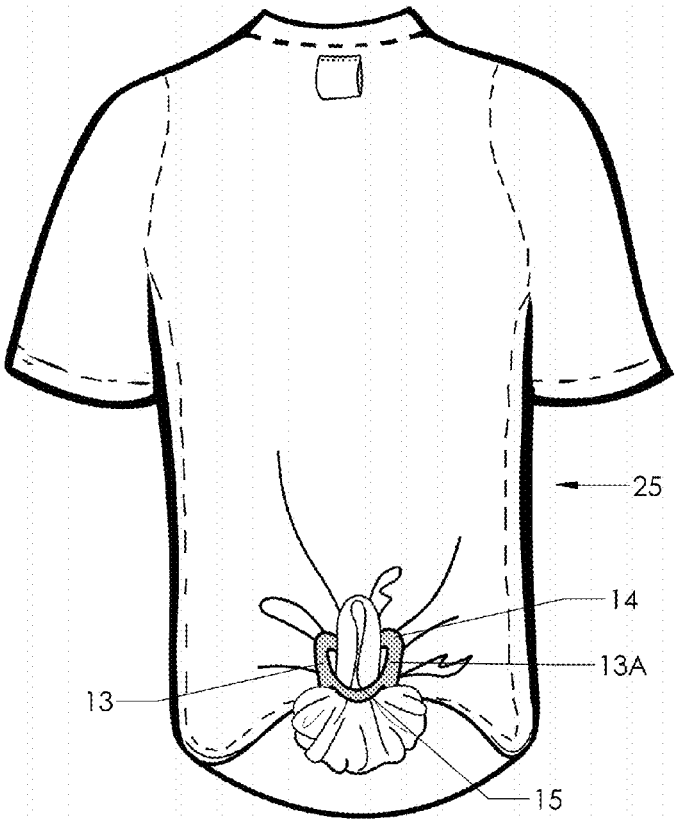
FIG. 7 is a rear view of the inside of a T-shirt wherein the fabric gathering process has been continued from that depicted in FIG. 6 and the leading edge of the fabric is shown exiting to the back through said first opening and upwardly therefrom.
Figure 8:
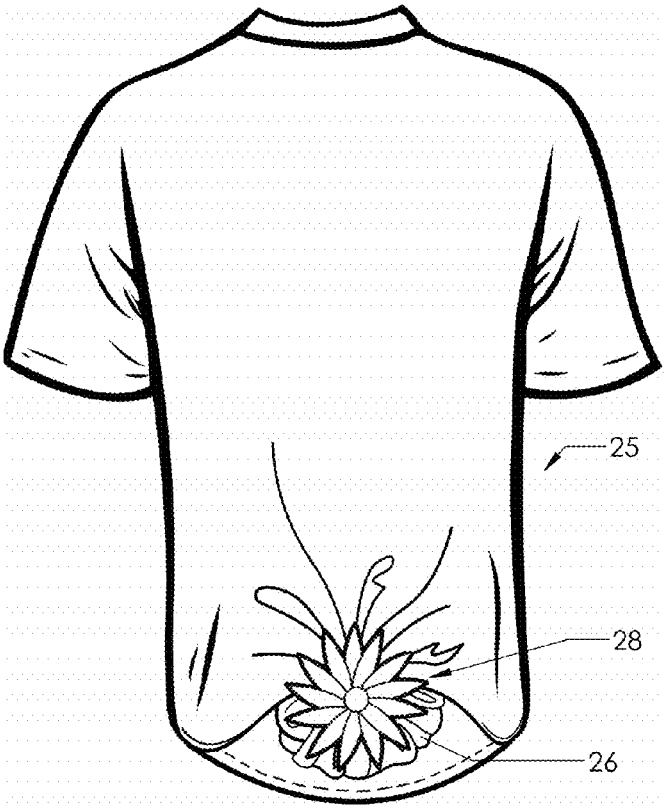
FIG. 8 is a front view of a T-shirt with the fabric containment device of this invention holding the gathered fabric at the lower part of the shirt.

In a preferred embodiment, the cloth may be pulled further along the back of device 10, and over upper side member 14 and upright supporting side members 13 and 13A covering the front sides thereof. This preferred embodiment has the advantage of providing a stronger hold as well as completely covering the device 10 except for a very small access to attachment means 20, this being covered when an accessory, such as decorative accessory 28 in FIG. 6 is attached. FIG. 8 shows a T-shirt 25 with the gathered fabric 26 held in this manner on the device 10 of this invention. FIG. 7 is a rear view of the inside of a T-shirt wherein the fabric gathering process has been continued from that depicted in FIG. 6 and the leading edge of the fabric is shown exiting to the back through said first opening and upwardly therefrom.

While the invention has been described in terms of certain preferred embodiments thereof, those skilled in the art will appreciate that certain modifications, substitutions, and changes may be made without departing from the spirit and scope of the invention as set forth in the claims herein.

What is claimed is:

1. A fabric containment device suitable for holding the gathered cloth of a garment comprising a four sided semi-rigid surrounding frame comprising a semicircular lower side member attached at each end to a lower end of one of two upright supporting side members which are further connected at their upper ends through an upper side member; said two upright supporting side members being further connected through an upper internal crossbar and a lower internal crossbar, said two upright supporting side members each being bent between the upper and lower internal crossbars to position the lower portion of said device in a plane slightly forward of the plane of the upper portion of said device; said crossbars and side members defining boundaries of three openings: a first opening bounded by said upper side member, said two upright supporting side members and said upper internal crossbar; a second opening bounded by said upper internal crossbar, said two upright supporting side members and said lower internal crossbar, and a third opening bounded by said lower internal crossbar, and said semicircular lower side member.

2. The fabric containment device of claim 1 wherein the lower internal crossbar is V-shaped.

3. The fabric containment device of claim 2 wherein the upper internal crossbar is rounded downwardly toward the lower internal crossbar.

4. The fabric containment device of claim 3 wherein the upper side member is V-shaped.

5. The fabric containment device of claim 2 wherein the lower internal crossbar includes an attachment means at the center point thereof.

6. The fabric containment device of claim 5 wherein the device further contains a detachable accessory attached to the attachment means thereof.

7. The fabric containment device of claim 6 wherein said detachable accessory is a decoration.

8. The fabric containment device of claim 6 wherein said detachable accessory is a light reflector.

9. A method of gathering and containing a portion of fabric in the fabric containment device of claim 1 comprising inserting the leading edge of the fabric through the front of said second opening to the back then pulling the fabric under said lower internal crossbar and through said third opening to the front then over and behind said semicircular lower side member of said surrounding frame to a position on the back, then through said second opening to the front, then up and through said first opening to the back.

10. The method of claim 9 wherein said fabric is additionally pulled up and over upper side member, and downwardly to cover the front side of said upper side member and said upright supporting side members.

* * * * *